United States Patent [19]

Walker

[11] Patent Number: 4,754,106

[45] Date of Patent: Jun. 28, 1988

[54] DOUBLE CAMMED PUSH-BUTTON SWITCH AND METHODOLOGY FOR OPERATION OF THE SAME

[75] Inventor: Frank Walker, Huntington Beach, Calif.

[73] Assignee: Symbolic Displays, Inc., Irvine, Calif.

[21] Appl. No.: 28,734

[22] Filed: Mar. 23, 1987

[51] Int. Cl.[4] ..... H01H 5/06; H01H 13/28

[52] U.S. Cl. ..... 200/67 A; 74/100 R; 200/6 B; 200/243; 200/153 J; 200/153 LA; 200/159 R

[58] Field of Search ..... 200/153 J, 67 A, 153 G, 200/67 R, 153 L, 153 LA, 67 PK, 340, 243, 5 R, 5 A, 6 R, 6 B, 159 R, 68.1, 68.2, 68.3; 74/99 R, 100 R, 483 PB

[56] References Cited

U.S. PATENT DOCUMENTS

| | | | |
|---|---|---|---|
| 1,538,882 | 5/1925 | Bates | 200/153 J |
| 2,076,073 | 4/1937 | Douglas | 200/153 J |
| 2,295,484 | 9/1942 | Krieger | 200/153 J |
| 2,576,771 | 11/1951 | Bentley | 200/67 A |
| 2,601,545 | 6/1952 | Miller | 200/153 J |
| 2,623,960 | 12/1952 | Haydon | 200/153 J |
| 2,668,204 | 2/1954 | Tregoning | 200/153 J X |
| 2,881,292 | 4/1959 | Winter et al. | 200/153 J X |
| 2,994,750 | 8/1961 | Raab | 200/159 R X |
| 3,789,173 | 1/1974 | Bury | 200/153 J |
| 4,204,102 | 5/1980 | Bull | 200/153 J |

FOREIGN PATENT DOCUMENTS

| | | | |
|---|---|---|---|
| 10835 | 10/1956 | Fed. Rep. of Germany | 200/153 J |
| 1141997 | 9/1957 | France | 200/153 J |
| 1167035 | 11/1958 | France | 200/153 J |

*Primary Examiner*—Henry J. Recla
*Assistant Examiner*—Ernest G. Cusick
*Attorney, Agent, or Firm*—George F. Bethel; Patience K. Bethel

[57] ABSTRACT

A compact, double-throw double-pole push-button electric switch is comprised of: a base; four electric terminals fixed to the base; a lower spring retainer pivoted on the base; a push-button key slidingly disposed and captively retain within a housing connected to the base; an upper retainer pivotally disposed within the push-button key and carrying a shorting bar between the opposing pairs of terminals; a coil compression spring captively retained at one end by the lower spring retainer and captively retained at its opposing end by the upper spring retainer; and a pair of double lobe cams connected to the lower spring. As the push-button is depressed, the camming surface within the push-button key comes into sliding contact with one of the two lobes of each of the cams. The cams rotate on the base and bring a fixed lever arm extending from the cam into contact with the shorting bar. The shorting bar is lifted from a contact with the electric terminals and rotated with the upper spring retainer across the gap between the terminals. Simultaneously, the coil spring becomes compressed and straighten. At that point where the cam has rotated sufficiently far so that the coil spring is flexed in the opposing direction, the coil spring will expand thereby snapping the shorting bar across the terminal gap.

8 Claims, 3 Drawing Sheets

DOUBLE CAMMED PUSH-BUTTON SWITCH AND METHODOLOGY FOR OPERATION OF THE SAME

BACKGROUND OF THE INVENTION

1. Field of the Invention

The invention relates to a push-button switch and more particularly to a rocking cam follower carrying a shorting bar which is actuated by depression of a key.

2. Description of the Prior Art

Push-button switches with rocking actuators are well known to the art. One such push-button switch is shown in COLEMAN III, "Rocking Switch Actuator For A Low Force Membrane Contact Switch," U.S. Pat. No. 4,528,431 (1985). A push-button switch having a pivotally mounted rocking actuator used in combination with a coil compression spring is also shown in ROBBINS, "Push-button switch With Pivotally Mounted Actuator," U.S. Pat. No. 3,491,218 (1970). Other kinds of spring loaded rocking push-button switches are illustrated in HARRIS, "Buckling Spring Torsional Snap Actuator," U.S. Pat. No. 4,118,611 (1978); and in HAGBERG, "Spring Biased-Spring actuated Momentary Switch," U.S. Pat. No. 3,165,611 (1965). A spring loaded toggling member used in combination with a rocking cam actuator in a push-button switch is shown in BULL, "Electrical Switch," U.S. Pat. No. 4,204,102 (1980).

However, each of these prior art push-button switch designs either utilize a rocking switch actuator used to move a pair of electrical contacts in a manner such that the rocking actuator is not positively cammed by the push button or key depression.

Each of these prior art designs utilize a toggle action with a coil spring providing a biased momentary contact. However, many prior art designs are of such a nature that the side profile of the switches are substantially greater than one-half an inch or require a push-button stroke of at least 3/16 of an inch in order to reliably actuate the switch.

Therefore, what is needed is a design for a push-button switch which is compact and which allows for a shorter key stroke than permitted by prior art designs. Furthermore, what is required is such a switch which is configured as a double-pole double-throw switch.

BRIEF SUMMARY OF THE INVENTION

The invention is a switch comprising a base, a plurality of terminals mounted on the base, a lower spring retaining mechanism pivotally mounted on the base which mechanism includes at least on double lobed cam, and an upper spring retaining mechanism which includes a shorting bar arranged and configured to selectively contact at least two subsets of the plurality of terminals. A spring is coupled between the lower spring mechanism and upper spring retaining mechanism. A push-button key is pivotally coupled to the upper spring retaining mechanism. The push-button key is further characterized by having at least two opposing internal camming surfaces arranged and configured to selectively contact the lobes of the cam which is included within the lower spring retaining mechanism. The push-button switch when depressed brings one of its camming surfaces into sliding contact with one of the lobes of the cam thereby rotating the cam with respect to the base. The upper spring retaining mechanism similarly rotates with the cam and spring. The upper spring retaining mechanism rotates with the cam to rotate the upper spring retaining mechanism at least through a portion of its entire rotation. A housing is coupled to the base, and the push-button key is slidingly disposed within the housing and captively retained therein. As a result a double-throw push-button switch utilizing a positive camming throw is provided.

In the illustrated switch the lower spring retaining mechanism includes at least two cams. Each cam contacts the shorting bar near opposing ends of the shorting bar. The cam comprises two symmetric lobes and an arm extending between the lobes. The arm contacts the spring retaining mechanism to urge the upper spring retaining mechanism to rotate within the housing when the cam is rotated by contact of the camming surface of the push-button key with one of the lobes.

The lower spring retaining mechanism is pivotally coupled to the base through a rocking dihedral wedge extending from the lower spring retaining mechanism into a corresponding dihedral indentation defined in the base. The dihedral angular opening of the indentation exceeds the dihedral angle of the wedge of the lower spring retaining mechanism.

The upper spring retaining mechanism is pivotally coupled to the push-button key by disposition of a dihedral wedge included as part of the upper spring retaining mechanism. The dihedral wedge is disposed and rocks within a corresponding dihedral indentation defined within the interior of the push-button key. The dihedral angle of the indentation defined within the interior of the push-button key is greater than the dihedral angle of the wedge of the upper spring retaining mechanism disposed within the indentation.

The spring mechanism is a coil compression spring seated at one end in the lower spring retaining mechanism and seated at its opposing end in the upper spring retaining mechanism.

The invention is also characterized as a method of providing a positively cammed double-throw switching action within a push-button switch comprising the steps of disposing a push-button key in a first direction defined as the downward vertical, engaging an interior camming surface of the push-button key against one lobe of a double lobed cam, rotating the double lobed cam in response to continued engagement between the camming surface of the push-button key and the lobe of the cam, pushing a shorting bar with an arm extending from the cam in a lever movement as the cam rotates, simultaneously compressing a spring mechanism coupled between the push-button key and the cam, and expanding the spring mechanism to continue rotation of the cam and movement of the shorting bar. The shorting bar thus is moved from a first position in contact with at least a first terminal to a second position in contact with at least a second terminal.

The method further comprising the steps of again disposing the push-button key, engaging the surfaces of lobes of the cam, rotating the cam in an opposite sense than first rotated, pushing the shorting bar in an opposite direction than originally pushed, simultaneously compressing the spring mechanism and then expanding the spring mechanism to continue rotation and movement of the shorting bar to return to the first position.

The invention is alternatively defined as an improvement in a double-throw push-button switch including a base, a plurality of electrical terminals, a push-button key, and a housing captively retaining the push-button key and terminals and connected to the base. The improvement comprises a double lobed cam. The lobes of the cam are arranged and configured to selectively contact and be driven by a camming surface defined within the push-button key. An electrical shorting bar selectively contacts at least two groups of the plurality of terminals. A mechanism is provided for moving the shorting bar from the first group of the plurality of terminals to the second group of the plurality of terminals in response to rotation of the cam. The cam is rotated in response to contact with the camming surface of the push-button key. Also included is a mechanism for resiliently biasing the shorting bar in contact with either the first or second group of terminals.

The invention and its various embodiments will be better understood by now turning to the following drawings where like elements are referenced by like numerals.

The invention and its detailed operation may be better understood by now turning to following detailed description.

DETAILED DESCRIPTION OF THE PREFERRED EMBODIMENTS

A compact, double-throw double-pole push-button electric switch, which is positively actuated through an internal camming action, is comprised of: a base; four electric terminals fixed to the base; a lower spring retainer pivoted on the base; a push-button key slidingly disposed and captively retained within a housing connected to the base; an upper retainer pivotally disposed within the push-button key and carrying a shorting bar between the opposing pairs of terminals; and a coil compression spring captively retained at one end by the lower spring retainer and captively retained at its opposing end by the upper spring retainer; and a pair of double lobe cams connected to the lower spring retainer and arranged in a camming relationship with a camming surface defined within the push-button key. As the push-button is depressed, the camming surface within the pedestal of the push-button key comes into sliding contact with one of the two lobes of each of the cams. The cams, being connected to the lower retainer, rotate on the base and bring a fixed lever arm extending from the cam into contact with the shorting bar. The shorting bar is thus lifted from a contact with the electric terminals and rotated with the upper spring retainer across the gap between the terminals. Simultaneously, the coil spring, captively retained between the lower and upper spring retainers, becomes compressed and straighten. At that point where the cam, together with the connected lower spring retainer and upper spring retainer, have rotated sufficiently far such that the coil spring begins to be flexed in the opposing direction, the coil spring will resiliently expand thereby snapping the shorting bar across terminal gap into contact with the opposing terminals. The upper spring retainer and lower spring retainer with its connected cams are thus quickly rotated across the terminal gap. The push-button key is then released, thereby moving out of contact with the double lobed cam. The shorting bar is now in electrical contact with the opposing pair of terminals, is reset and ready for a reverse identical operation which will bring the shorting bar once again across the terminal gap to the opposing set of terminals.

Figure 1:
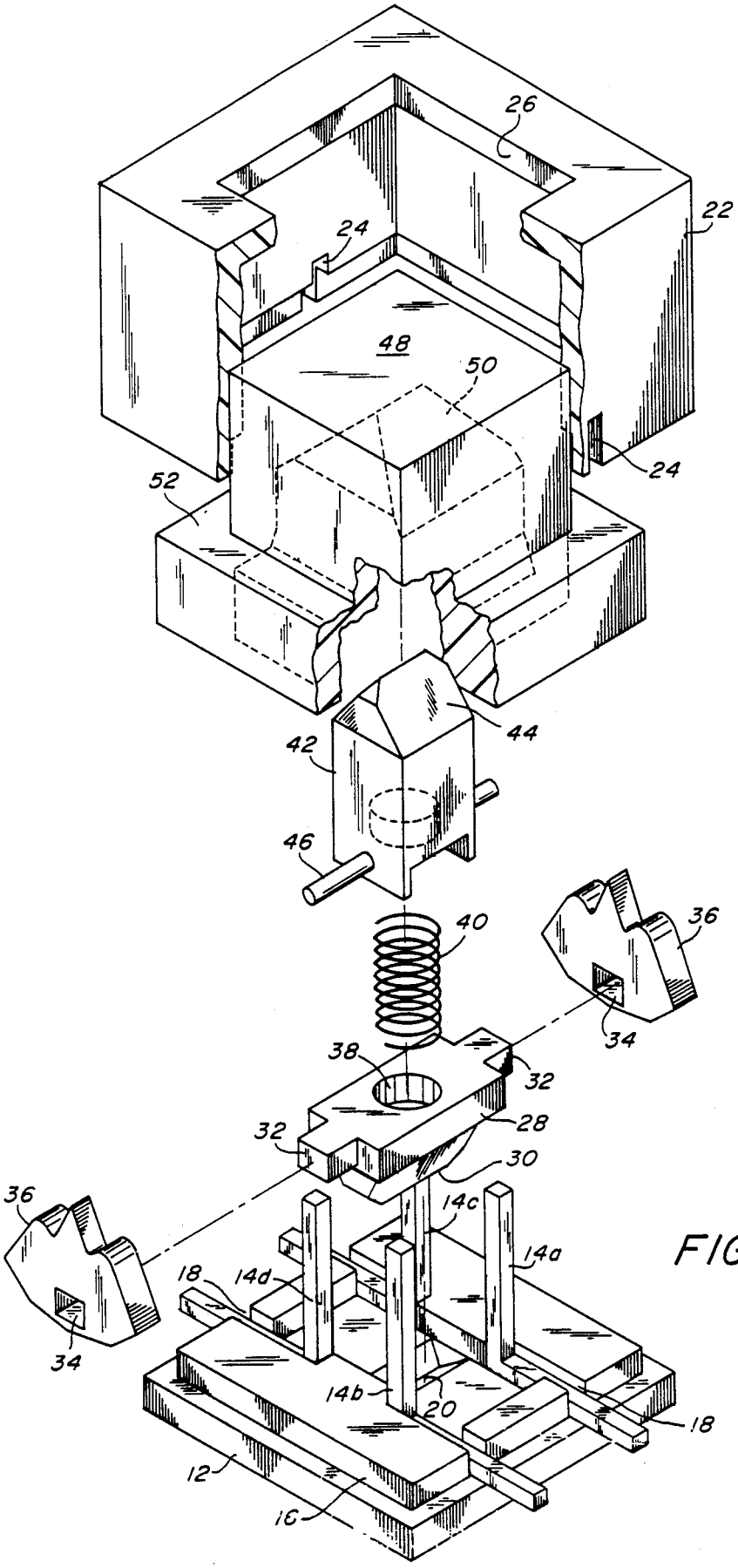
FIG. 1 is an exploded perspective view of the switch component parts of the invention.

The constituent parts of the push-button switch according to the invention are best depicted in exploded perspective view in FIG. 1. The push-button switch, generally denoted by reference numeral 10, is comprised of a base 12 which includes four conductive or metallic terminals 14*a*–14*d*. Terminals 14*a*–14*d* are diagrammatically depicted in the Figures and particular are depicted as right angled brackets having their base mounted onto switch base 12 and extending therefrom for appropriate attachment to a switch bore and other circuitry. Other forms for terminals 14*a*–14*d* could be utilized without departing from the spirit and scope of the invention.

Base 12 is a plastic molded part which includes a circumferential rectangular lip 16 having cutouts 18 through which the base of terminals 14*a*–14*d* extend. Also defined into base 12 is a dihedral indentation 20 which will serve as a pivot point for a lower spring retainer described below.

Shown above base 12 in the exploded view of FIG. 1 is a plastic rectangular molded housing 22 which is arranged and configured to snuggly snap fit over lip 16 and base 12. Housing 22 similarly has cutouts 24 defined in opposing sides along its lower edge corresponding to cutouts in lip 16 to accommodate passage of the basis of terminal 14*a*–14*d*. The upper portion of housing 20 has a rectangular aperture 26 defined therein through which a push-button key, described below, is slidingly disposed.

Shown above base 12 in the exploded view of FIG. 1, but actually resting on and disposed within dihedral indentation 20 in base 12 is a lower spring retainer 28. Lower spring retainer 28 is a plastic molded element which is generally rectangular in form and has a dihedral wedge 30 extending from its lower portion. Wedge 30 is sized to conveniently rock back and forth along the common axis of dihedral indentation 20 and dihedral wedge 30 as better depicted in FIGS. 2–5. Lower spring retainer 28 has key elements 32 longitudinally extending from each end of its upper portion for fixed insertion into a corresponding rectangular hole 34 provided in the lower portion of each of two double lobed cams 36. Two such double lobed cams are provided and are shown in FIG. 1. The operation and nature of double lobed cams 36 is better described below in connection FIGS. 2–5.

Lower spring retainer 28 also has a circular indentation 38 defined in its upper portion for receiving a coil compression spring 40. Coil compression spring 40 extends upwardly from lower spring retainer 28 into and is retained by an upper spring retainer 42. Upper spring retainer 42 is generally rectangular and is provided with a dihedral wedge termination 44 at the upper end of upper spring retainer 42. Spring retainer 42 also includes a conductive shorting bar 46 disposed through its lower portion in a direction generally parallel to the common apical line of indentation 20 and wedge 30. As will be seen in FIGS. 2–5, shorting bar 46 is ultimately placed into contact with terminals 14*a* and 14*b* on one hand or terminals 14*c* and 14*d* on the other hand.

Upper spring retainer 42 is disposed within a push-button key 48. Key 48 is generally rectangular, and as previous stated, is disposed through rectangular aperture 26 in housing 22. The interior of key 48 is hollowed to permit a freely rocking insertion of upper spring retainer 42 therein as better depicted in FIGS. 2–5. Thus, the upper interior surface of key 48 is provided with a dihedral indentation 50 shown in dotted outline in FIG. 1. In the same manner that wedge 30 of lower spring retainer 28 is disposed in and rocks within dihedral indentation 20 of base 12, dihedral wedge 44 of upper spring retainer 42 is disposed in and rocks within dihedral indentation 50 defined in the interior upper surface of key 48. Key 48 is expanded at its lower portion to form a pedestal 52 which includes at least two opposing camming surfaces 54 better depicted in FIGS. 2–5.

As will be described below, camming surfaces 54 of key 48 will contact double lobed cams 36 to provide a positive, cammed, double-pole switch actuation.

The various components of switch 10 now having been separately described in the context of the exploded view of FIG. 1, turn now to the assembled cross-sectional views of FIGS. 2–5 wherein the operation and co-action of the various structural elements are described.

Figure 2:
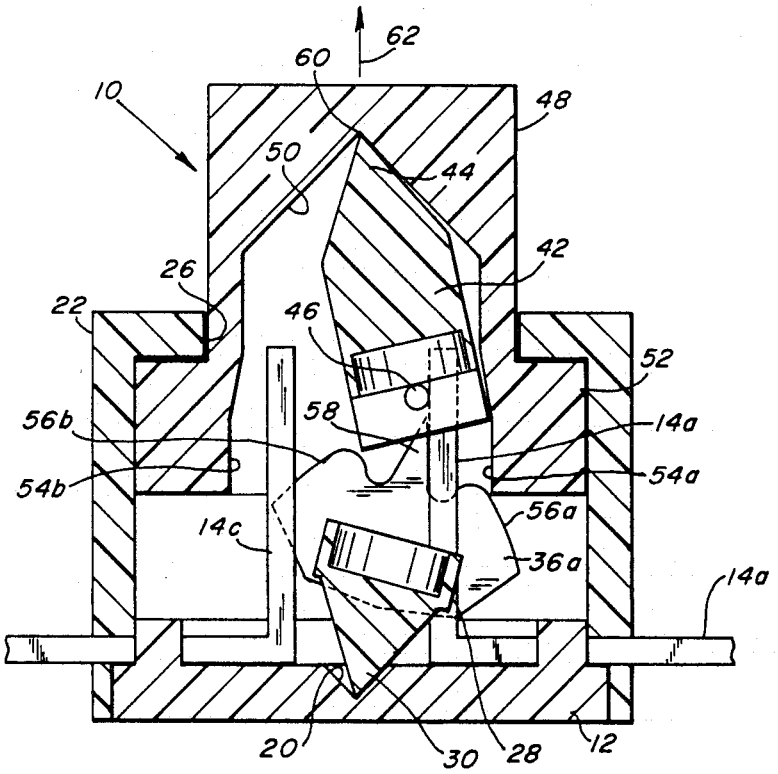
FIG. 2 is a diagrammatic sectional side view of a push-button switch of FIG. 1 shown in a first position.

FIG. 2 is side sectional view of switch 10 depicting the switch elements, with spring 40 removed for the sake of clarity, just after key 48 has begun to be depressed and shorting bar 46 has just lifted off terminals 14*a* and 14*b*. In the sectional view of FIG. 2, only terminal 14*a* and one of double cam lobes 36 is seen.

As key 48 is pushed downwardly, camming surface 54*a* in the interior of pedestal 52 of key 48 bears against the right lobed surface 56*a* of cam 36 as seen in FIG. 2. This imparts a torque to cam 36 which begins to rotate in a counter-clockwise direction in FIG. 2. As cam 36 rotates, pointed arm 58 of cam 36 contacts shorting bar 46 and begins to move shorting bar 46 away from terminal 14*a* and across the separation between the terminals toward terminal 14*c*.

As cam 36 continues to rotate with the continued downward movement of key 48, coil spring 40, which is not shown, is compressed between upper spring retainer 42 and lower spring retainer 28. Lower spring retainer 28 and upper spring retainer 42 each rock within their corresponding dihedral indentations 20 and 44 respectively. The dihedral angle of the dihedral wedges 30 and 44 are each sufficiently smaller than the dihedral angle of indentations 20 and 50 respectively to permit free rotation of spring retainers 28 and 42 across the entire range of motion of shorting bar 46.

Figure 4:
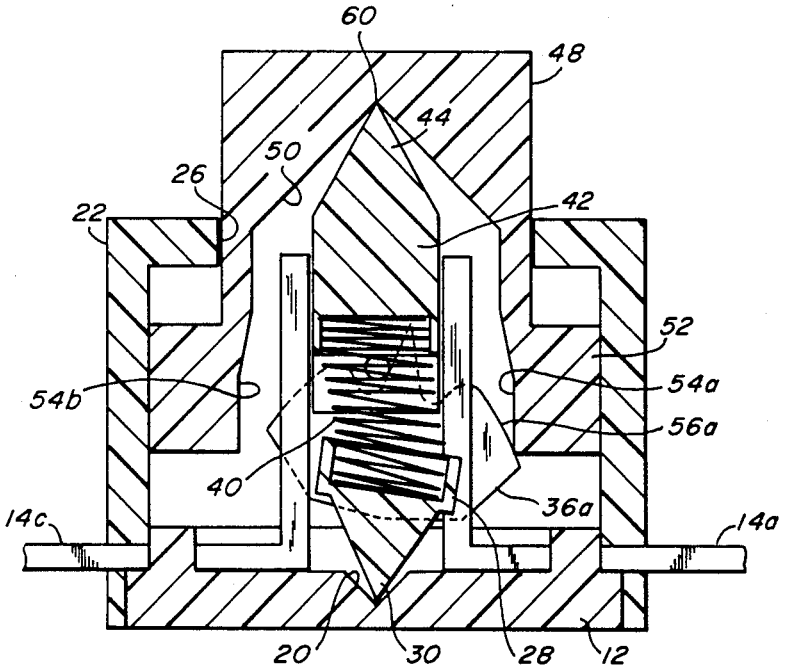
FIG. 4 is a side sectional view of FIG. 2 after the push-button key has been depressed partially through the stroke bringing the doubly cammed actuator near its midpoint position.

Ultimately, key 48 will be pushed downwardly far enough and the camming action between surface 54*a* with cam surface 56*a* will rotate cam 36 until upper spring retainer 48 and lower spring retainer 28 are in a midpoint or vertical configuration within switch 10 as depicted in FIG. 4. At this point, spring 40, which is depicted in FIG. 4 for the purposes of clarity, will be maximally compressed. Any further counter clockwise rotation of cam 36 serves to push shorting bar 46 across the midpoint shown in FIG. 4 and thereby allows compression spring 40 relax or expand.

At this point, spring 40 expands thereby continuing to rotate cam 36 in a counterclockwise direction and upper spring retainer 42 in a clockwise direction as shown in FIGS. 2–5. Lower spring retainer 28 and cams 36 attached thereto together with upper spring retainer 42 thus snap across the gap between terminals 14*a* and 14*c* and thereby bring shorting bar 46 into firm contact with the opposing electrodes 14*c* and 14*d*.

As shorting bar 46 moves across the gap between terminals 14*a* and 14*b* and 14*c* and 14*d*, shorting bar 46 rotates about an axis 60 which is the common point of contact between the dihedral wedge 44 and indentation 50. However, axis of rotation 60 also reciprocates along vertical axis as key 48 is depressed and then later released. Shorting bar 46 is thus brought within range for contact with pointed arm 58 of each cam 36. Therefore, as key 48 is maximally depressed, axis 60 will carry shorting bar 46 across the terminal gap and bring it into positive contact with terminals 14*c* and 14*d*. An audible snap or click on the push-button switch 10 will be heard or felt.

Figure 5:
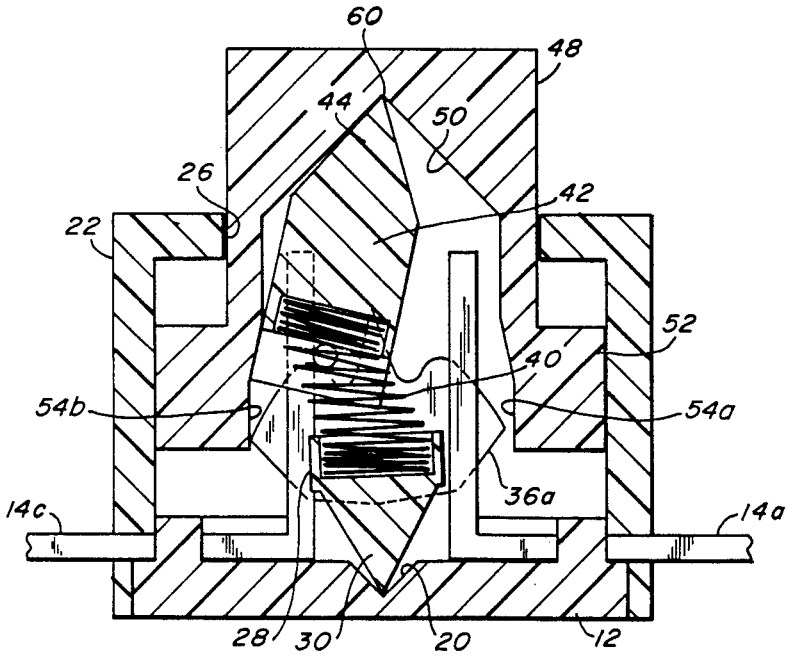
FIG. 5 is side sectional view of FIGS. 2 and 4 showing a push-button key fully depressed and the doubly cammed actuator triggered to throw the switching bar to its second position.

Thereafter, as key 48 is released, axis 60 moves vertically upwardly carrying shorting bar 46 with it by virtue of the continued expansion of coil spring 40. However, as shorting bar moves upward with key 48, it is removed from contact with pointed arm 58 of cam 36. At this point cam 36 will continue to rotate in a counterclockwise direction in FIGS. 2–5 as shown in FIG. 5 under the urging of coil spring 40.

Figure 3:
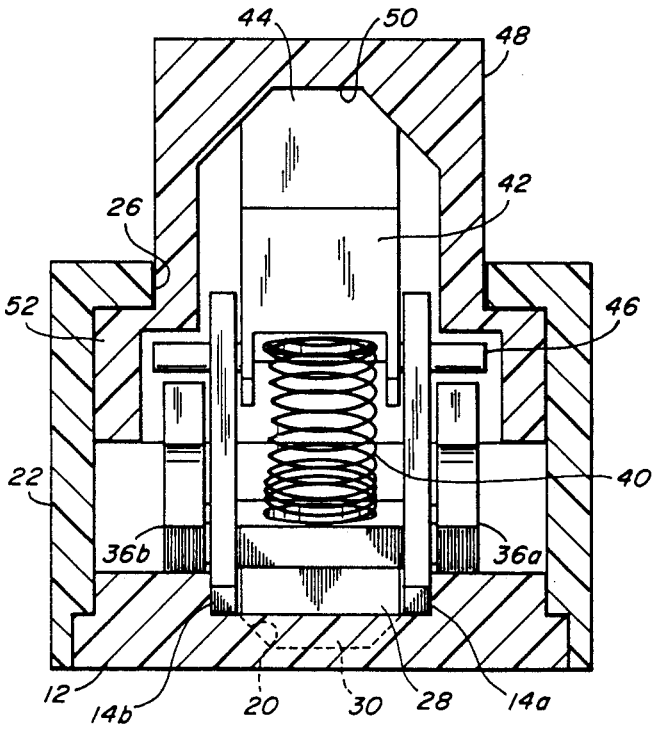
FIG. 3 is a diagrammatic sectional view of the switch of FIG. 2 taken through a section perpendicular to the section illustrated in FIG. 2.

Push-button switch 10 is now arranged and configured oppositely to that shown in FIG. 2. Switch 10 is returned to its original configuration by a reverse operation by a second depression of key 48 in an analogous manner as previously described. Clearly, in the reverse operation, that is moving from the configuration of FIG. 5 to that of FIG. 2, a opposing camming surface 54*b* of pedestal 52 will contact cammed lobe 56*b* of cam 36 and the opposing side of pointed arm 58 will pick up shorting bar 46 and carry it across to the opposing terminals 14 and 14*b*. FIG. 3 is a side sectional view of switch 10 as seen through a section perpendicular to that illustrated in FIGS. 2, 4 and 5. Therefore, FIG. 3 clearly shows a double camming action with two cams 36*a* and 36*b*, each of which operate in an identical manner as just described.

Many modifications and alterations may be made by those having ordinary skill in the art without departing from the spirit and scope of the invention. Therefore, the illustrated embodiment has been shown only for the purposes of example and should not be taken as limiting the invention which is defined in the following claims.

I claim:

1. A switch comprising:

a base;

a plurality of terminals mounted on said base arranged to comprise at least two opposing subsets of terminals;

a lower spring retaining means pivotally mounted on said base so as to rotate and including at least one double lobed cam;

an upper spring retaining means including a shorting bar, said shorting bar arranged and configured to selectively contact one of said two subsets of said plurality of terminals;

a spring means coupled between said lower spring retaining means and upper spring retaining means;

a push-button key, said upper spring retaining means pivotally coupled to said push-button key, so as to rotate said push-button key further characterized by having at least two opposing internal camming surfaces arranged and configured to selectively contact said double lobed cam disposed within said lower spring retaining means, said push-button key operable when depressed to bring one of said camming surfaces into sliding contact with one of said lobes of said cam thereby rotating said cam with respect to said base, said upper spring retaining means similarly rotating with said cam and spring means, said upper spring retaining means rotating with said cam to rotate said upper spring retaining means at least through a portion of the rotation of said upper spring retaining means; and a housing coupled to said base, said push-button key slidingly disposed within said housing and captively retained therein, wherein said cam comprises two symmetric lobes and an arm extending between said lobes, said arm for contacting said upper spring retaining means to urge said upper spring retaining means to rotate within said housing when said cam is rotated by contact of said camming surface of said push-button key with one of said lobes, whereby a double-throw push-button switch utilizing a positive cammed throw is provided.

2. A switch comprising:

a base;

a plurality of terminals mounted on said base arranged to comprise at least two opposing subsets of terminals;

a lower spring retaining means pivotally mounted on said base so as to rotate and including at least one double lobed cam;

an upper spring retaining means including a shorting bar, said shorting bar arranged and configured to selectively contact one of said two subsets of said plurality of terminals;

a spring means coupled between said lower spring retaining means and upper spring retaining means;

a push-button key, said upper spring retaining means pivotally coupled to said push-button key, so as to rotate said push-button key further characterized by having at least two opposing internal camming surfaces arranged and configured to selectively contact said double lobed cam disposed within said lower spring retaining means, said push-button key operable when depressed to bring one of said camming surfaces into sliding contact with one of said lobes of said cam thereby rotating said cam with respect to said base, said upper spring retaining means similarly rotating with said cam and spring means, said upper spring retaining means rotating with said cam to rotate said upper spring retaining means at least through a portion of the rotation of said upper spring retaining means; and a housing coupled to said base, said push-button key slidingly disposed within said housing and captively retained therein, wherein said lower spring retaining means is pivotally coupled to said base through a rotatable dihedral wedge extending from said lower spring retaining means into a corresponding parallel dihedral indentation defined in said base, the angular opening of said dihedral indentation exceeding said angle of said dihedral wedge of said lower spring retaining means, whereby a double-throw push-button switch utilizing a positive cammed throw is provided.

3. The switch of claim 2 wherein said upper spring retaining means is pivotally coupled to said push-button key by disposition of a dihedral wedge included as part of said upper spring retaining means, said dihedral wedge disposed and rocking within a corresponding dihedral indentation defined within said push-button key, the angular opening of said indentation defined within said push-button key being greater than the angle of said dihedral wedge of said upper spring retaining means disposed within said indentation.

4. A switch comprising:

a base;

a plurality of terminals mounted on said base arranged to comprise at least two opposing subsets of terminals;

a lower spring retaining means pivotally mounted on said base so as to rotate and including at least one double lobed cam;

an upper spring retaining means including a shorting bar, said shorting bar arranged and configured to selectively contact one of said two subsets of said plurality of terminals;

a spring means coupled between said lower spring retaining means and upper spring retaining means;

a push-button key, said upper spring retaining means pivotally coupled to said push-button key, so as to rotate said push-button key further characterized by having at least two opposing internal camming surfaces arranged and configured to selectively contact said double lobed cam disposed within said lower spring retaining means, said push-button key operable when depressed to bring one of said camming surfaces into sliding contact with one of said lobes of said cam thereby rotating said cam with respect to said base, said upper spring retaining means similarly rotating with said cam and spring means, said upper spring retaining means rotating with said cam to rotate said upper spring retaining means at least through a portion of the rotation of said upper spring retaining means; and a housing coupled to said base, said push-button key slidingly disposed within said housing and captively retained therein, wherein said upper spring retaining means is pivotally coupled to said push-button key by disposition of a dihedral wedge included as part of said upper spring retaining means, said dihedral wedge disposed and rotatable within a corresponding dihedral indentation defined within said push-button key, the angular opening of said dihedral indentation defined within said push-button key being greater than the angle of said dihedral wedge of said upper spring retaining means disposed within said indentation, whereby a double-throw push-button switch utilizing a positive cammed throw is provided.

5. A method of providing a positively cammed doublethrow switching action within a push-button switch comprising the steps of:

disposing a push-button key in a first direction defined as the downward vertical;

engaging an interior camming surface of said push-button key against one lobe of a double lobed cam;

rotating said double lobed cam in response to continued engagement between said camming surface of said push-button key and said lobe of said cam;

pushing a shorting bar above said cam with an arm extending from said cam in a lever movement as said cam rotates;

simultaneously compressing a spring means coupled between said push-button key and said cam; and expanding said spring means to continue rotation of said cam and movement of said shorting bar, said shorting bar thus being moved from a first position in contact with at least a first terminal to a second position in contact with at least a second terminal.

6. A method of providing a positively cammed double-throw switching action within a push-button switch comprising the steps of:

disposing a bush-button key in a first direction defined as the downward vertical;

engaging an interior camming surface of said push-button key against one lobe of a double lobed cam;

rotating said double lobed cam in response to continued engagement between said camming surface of said push-button key and said lobe of said cam;

pushing a shorting bar above said cam with an arm extending from said cam in a lever movement as said cam rotates;

simultaneously compressing a spring means coupled between said push-button key and said cam; and expanding said spring means to continue rotation of said cam and movement of said shorting bar, said shorting bar thus being moved from a first position in contact with at least a first terminal to a second position in contact with at least a second terminal, where in said step of rotating said cam, said cam is rotated about a predetermined axis defined by a common pivot line between a dihedral wedge-shaped lower spring retainer coupled to said cam and a corresponding dihedral indentation defined in a base in which said lower spring retainer is disposed, and in which said lower spring retainer rotates.

7. A method of providing a positively cammed double-throw switching action within a push-button switch comprising the steps of:

disposing a push-button key in a first direction defined as the downward vertical;

engaging an interior camming surface of said push-button key against one lobe of a double lobed cam;

rotating said double lobed cam in response to continued engagement between said camming surface of said push-button key and said lobe of said cam;

pushing a shorting bar above said cam with an arm extending from said cam in a lever movement as said cam rotates;

simultaneously compressing a spring means coupled between said push-button key and said cam; and expanding said spring means to continue rotation of said cam and movement of said shorting bar, said shorting bar thus being moved from a first position in contact with at least a first terminal to a second position in contact with at least a second terminal, further comprising the steps of again disposing said push-button key, engaging said surfaces of lobes of the cam, rotating said cam in an opposite sense then first rotated, pushing said shorting bar in an opposite direction than originally pushed, simultaneously compressing said spring means and then expanding said spring means to continue rotation and movement of said shorting bar to return to said first position.

8. An improvement in a double-throw push-button switch including a base, a plurality of electrical terminals, a push-button key having an interior camming surface, and a housing captively retaining said push-button key and terminals and connected to said base, said improvement comprising;

a double lobed cam having two lobes, said lobes of said cam arranged and configured to selectively contact and be driven by said camming surface defined within said push-button key;

an electrical shorting bar selectively contacting at least a first and second opposing set of said plurality of terminals;

means for moving said shorting bar from said first set of said plurality of terminals to said second set of said plurality of terminals in response to rotation of said cam, said cam being rotated in response to contact with said camming surface of said push-button key; and means for resiliently biasing said shorting bar in contact with either said first or second group of terminals, wherein said means for moving said shorting bar is a lever arm rotating with said cam thereby moving said shorting bar from said first to said second group of terminals and vice versa.

* * * * *